United States Patent [19]

Bergman et al.

[11] Patent Number: 4,942,331

[45] Date of Patent: Jul. 17, 1990

[54] FILAMENT ALIGNMENT SPUD FOR INCANDESCENT LAMPS

[75] Inventors: Rolf S. Bergman, Cleveland Heights; William O. Harris, E. Cleveland, both of Ohio

[73] Assignee: General Electric Company, Schenectady, N.Y.

[21] Appl. No.: 349,282

[22] Filed: May 9, 1989

[51] Int. Cl.[5] ..... H01K 1/18; H01K 1/40

[52] U.S. Cl. ..... 313/271; 313/274; 313/112; 313/579; 313/623

[58] Field of Search ..... 313/271, 274, 285, 286, 313/579, 623, 112

[56] References Cited

U.S. PATENT DOCUMENTS

| | | | |
|---|---|---|---|
| 3,392,299 | 7/1968 | Kern | 313/274 X |
| 3,535,577 | 10/1970 | Notelteirs et al. | 313/274 X |
| 3,712,701 | 1/1973 | Johnston et al. | 445/27 |
| 3,784,865 | 1/1974 | Shanks | 313/274 |
| 4,017,758 | 4/1977 | Almer et al. | 313/112 |
| 4,229,066 | 10/1980 | Rancourt et al. | 350/1.6 |
| 4,389,201 | 6/1983 | Hansler et al. | 445/26 |
| 4,588,923 | 5/1986 | Hoegler et al. | 313/579 |
| 4,629,935 | 12/1986 | Keenan | 313/579 |
| 4,629,936 | 12/1986 | Weld et al. | 313/579 |
| 4,652,789 | 3/1987 | Kawakatsu et al. | 313/112 |
| 4,663,557 | 5/1987 | Martin, Jr. et al. | 313/112 |
| 4,701,663 | 10/1987 | Kawakatsu et al. | 313/112 |
| 4,801,932 | 1/1989 | Takubo et al. | 340/783 |

*Primary Examiner*—Kenneth Wieder

*Attorney, Agent, or Firm*—Edward M. Corcoran; Stanley C. Corwin; Fred Jacob

[57] ABSTRACT

A spud made of refractory metal wire in the shape of a ring with a loop on each side radially aligns and provides electricity to a filament in a double ended tungsten halogen lamp. The spud has a leg extending from the end of each loop, one of which is attached to the filament and the other forming part of an inlead assembly. This spud is particularly useful with relatively small size double ended tungsten-halogen lamps having an infrared reflecting coating on the surface of the vitreous filament chamber.

15 Claims, 2 Drawing Sheets

FILAMENT ALIGNMENT SPUD FOR INCANDESCENT LAMPS

BACKGROUND OF THE INVENTION

1. Field of the Invention

This invention relates to a spud for centering a filament in an incandescent lamp. More particularly, this invention relates to a spud for radially aligning a filament in a double ended tungsten halogen lamp wherein said spud is made of refractory metal wire in the shape of a circular ring having a loop on both sides of said ring which extend towards the center of the ring and with one of each of said wire ends extending out from a respective end of each loop, one end of which is attached to the filament and the other end being part of an inlead.

2. Background of the Disclosure

Double ended filament lamps comprising a generally tubular vitreous envelope enclosing a filament within and being hermetically sealed at both ends are well known to those skilled in the art. Such lamps include heat lamps which are generally made of a quartz tube enclosing an elongated tungsten filament supported along its length by one or more filament supports, with the tube hermetically sealed on both ends by means of a pinch seal over a molybdenum foil seal assembly. Heat lamps of this type do not generally require precise centering of the filament in the quartz tube. A relatively recent development is a double ended tungsten halogen lamp containing a tungsten filament and one or more halogens within the filament chamber, with the surface of the filament chamber containing a coating or filter which transmits visible light radiation, but which reflects infrared radiation back to the filament to decrease the amount of electrical power used by the lamp with no decrease in visible light output. Such lamps require precise radial alignment of the filament along the optical center of the filament chamber in order to achieve maximum conversion of the infrared radiation reflected by the coating back to the filament to visible light radiation which is transmitted by the filter.

Thin film optical interference filters for reflecting infrared radiation emitted by a filament back to the filament while at the same time transmitting the visible light portion of the electromagnetic spectrum emitted by the filament and their applications as coatings on lamps are known to those skilled in the art and may be found, for example, in U.S. Pat. Nos. 4,017,758; 4,652,789; 4,663,557 and 4,701,663. For example, it is known that light interference filters made up of alternating layers of tantala and silica may be employed on the outer surface of a vitreous filament chamber for selectively reflecting infrared radiation emitted by the filament back to the filament and which preferentially transmits radiation in the visible portion of the electromagnetic spectrum. In these types of filters the infrared radiation is reflected by the filter or coating back to the filament wherein at least a portion is reconverted to light radiation in the visible portion of the electromagnetic spectrum, thereby greatly increasing the efficacy of the lamp and, at the same time, reducing the amount of heat emitted by the lamp. In those applications wherein it is desired to reflect at least a portion of the infrared radiation emitted by the filament back to the filament for conversion into visible light radiation, it is important that the filament be fairly precisely centered or aligned along the optical axis of the filament chamber in order for the filter to work effectively. That is, if the filament isn't at the optical center of the coated filament chamber, then a substantial portion of the infrared radiation reflected by the filter will miss the filament and strike the wall on the other side of the chamber. As a practical matter, all coatings or filters that reflect infrared radiation also transmit a small fraction of the radiation striking the filter. Accordingly, a portion of the infrared radiation is transmitted by the filter at each reflection. Thus, a substantial portion of infrared radiation which undergoes multiple reflections before encountering the filament can be lost through the filter before being converted into visible light radiation.

Single ended tungsten halogen incandescent lamps comprising a vitreous envelope made out of quartz or a suitable high temperature glass, such as an aluminosilicate glass, which enclose a tungsten filament along with one or more halogen compounds and a getter such as phosphorus or phosphine in the filament chamber are also well known to those skilled in the art. Such lamps are disclosed, for example, in U.S. Pat. Nos. 3,712,701; 4,629,935; 4,629,936. In these lamps the tungsten filament is mounted axially along the length of the lamp within the vitreous lamp envelope by inleads which are hermetically sealed in the end of the lamp. In these types of lamps, employing an infrared reflective coating around the envelope or filament chamber is not normally effective, because it is difficult to radially align the filament along the optical center of the envelope. Furthermore, the construction of single ended tungsten halogen lamps makes it extremely difficult to shape the ends of the vitreous envelope so that the reflected radiation is returned to the filament with a minimum number of reflections. For these reasons increasing attention has been given to constructing double ended tungsten halogen lamps which comprise a vitreous envelope having a bulbous filament chamber and terminating at both ends in tubular portions. Such lamps are disclosed, for example, in U.S. Pat. No. 4,810,932 the disclosures of which are incorporated herein by reference. However, there still remains a need for precisely centering or radially aligning the tungsten filament within the vitreous envelope.

SUMMARY OF THE INVENTION

The present invention relates to a spud for radially aligning and providing electricity to the filament in the filament chamber of a double ended incandescent lamp. The spud comprises a refractory metal wire in the shape of a circular ring having at least one turn and with a loop on both sides of said ring which have a diameter smaller than that of said ring and which extend toward the center thereof, with a leg extending out from the end of each of said loops away from each other and being generally perpendicular to the plane of said ring. It is preferred that at least one of said legs is coaxial with the center of said ring. One of the legs is attached to one end of the filament and the other leg acts as all or a portion of an inlead. The lamp is preferably a double ended tungsten halogen lamp having an infrared reflecting coating on the surface of the filament chamber. Thus, the present invention relates to a double ended tungsten halogen lamp comprising a vitreous, light transmissive envelope having a mid portion of a predetermined generally spherical or elliptical shape as a filament chamber which is coated with a coating which reflects infrared radiation and transmits visible light radiation, said chamber enclosing a filament and one or more halogen compounds and inert gas within, said envelope terminating at each end in a tubular portion, with said filament being radially aligned in said chamber along the optical center thereof, being attached to and supported at each end by a spud located in each of said two tubular portions, said spud made of refractory metal wire in the shape of a ring having at least one turn and with a loop on each side of said ring having a diameter smaller than that of said ring and which extends towards the center thereof, with a leg extending out from the end of each of said loops away from each other and being generally perpendicular to the plane of the ring and coaxial with the center thereof, with one of said legs being attached to a respective end of said filament and the other leg being at least a portion of an inlead.

In a preferred embodiment one leg will be attached to the filament by plasma welding or laser welding and the other leg will be generally coaxial with the center of the ring. In a particularly preferred embodiment of the invention the spud leg which is to be welded to the filament will terminate in an "L" shaped portion. This permits welding of the leg to the filament by plasma or laser welding without shorting across the filament turns. It is also particularly preferred that both legs be generally coaxial with the center of said ring at least at that portion of said legs which extends from said loops.

DETAILED DESCRIPTION

Figure 1A:
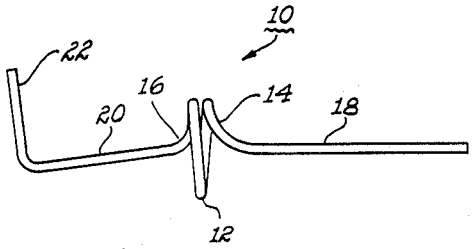
FIG. 1*a* and FIG. 1*b* schematically illustrate one embodiment of a spud of the present invention.
Figure 1B:
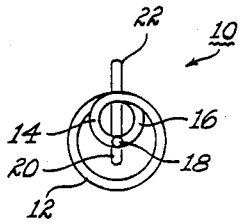
Figure 2:
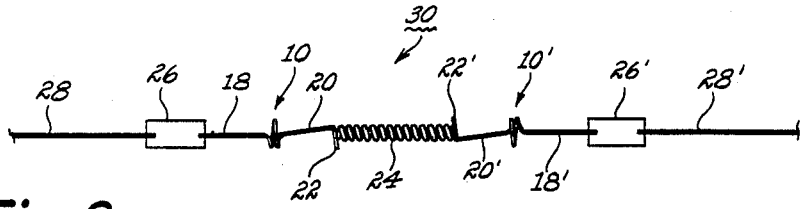
FIG. 2 schematically illustrates spuds of the present invention as part of an inlead prior to welding the L-shaped portion of the spud legs to the filament.
Figure 3:
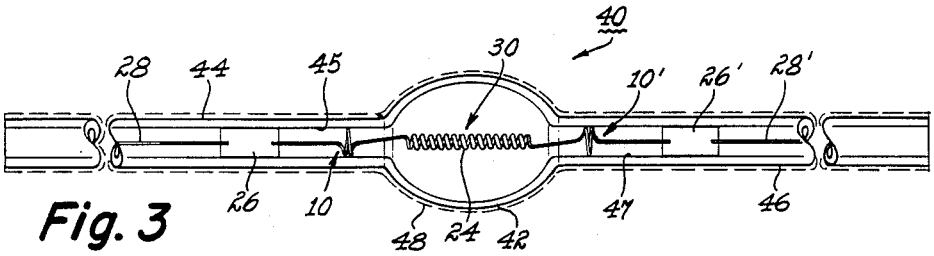
FIG. 3 schematically illustrates a double ended lamp glass envelope containing a filament assembly employing spuds of the present invention.

Turning now to FIG. 1, spud 10 is shown comprising ring or coil 12 which in this embodiment is made of one turn terminating at both sides in loops 14 and 16 which have a diameter smaller than that of ring 12 and which extend toward the center thereof, with legs 18 and 20 extending from the respective ends of loops 14 and 16 in a direction direction generally perpendicular to the plane of ring 12 and away from each other. Leg 20 preferably terminates in L-shaped portion 22 for welding to a filament. Leg 18 in turn may be welded to a molybdenum foil (as shown in FIG. 2) for effecting a hermetic seal of the lamp or may extend through the lamp seal portion. Spud 10 is made of a suitable refractory metal wire such as molybdenum, tungsten, and the like. Molybdenum is particularly preferred because of its electrical properties and formability characteristics. Although spud 10 is depicted as having a ring 12 which consists essentially of one complete turn, exclusive of loops 14 and 16, it is understood that ring 12 may consist of a multiple number of turns if desired. As a practical matter it is generally preferred to keep the number of turns which make up ring 12 to less than about three. Similarly, if desired, loops 14 and 16 can consist of more than one, two or more turns and not just the half turn (180°) illustrated in FIG. 1. When viewed as shown in FIG. 1 with the plane of ring 12 in a vertical position, leg 20 is offset or tilted downwardly from the horizontal by a small angle so that the bend between leg 20 and L-shaped portion 22 will be below the top of filament coil 24 to facilitate welding of a portion of 22 to filament 24. It is also preferred that the bottom of leg 20 be within the cylinder defined by outer diameter of the filament after the welding of L-shaped portion 22 to the filament. Finally, L-shaped portion 22 is illustrated not as being vertical, but as being tilted at an angle away from the coil portion 12 of spud 10 in order to prevent the bottom portion or bend defined by the intersection of 20 and 22 from contacting the bottom portion or turn of the filament. An angle of about 15° off vertical has been found satisfactory for accomplishing this purpose. Spud 10 not only serves to align the filament in the lamp in a precise fashion, it also provides a low impedance electrical connection to the filament and does not impede the flow of gas into and out of the vitreous lamp envelope when it is present in the tubular portions of the lamp envelope during lamp production, as the lamp assembly is flushed and filled with inert gas during the manufacturing process. U.S. Pat. No. 4,810,932 the disclosures of which are incorporated herein by reference, discloses a suitable manufacturing process for making lamps of the type shown in FIGS. 3 and 4 which are useful with the present invention.

FIG. 2 illustrates spuds of the present invention as part of a molybdenum foil inlead assembly used for the hermetic seal in an assembled lamp according to one embodiment. Thus, FIG. 2 illustrates spuds 10 and 10' with the L portion 22 and 22' of legs 20 and 20' adjacent to and touching the ends of filament 24, with a part of each L portions 22 and 22' projecting somewhat above the outer diameter of double coil tungsten filament 24. Spud legs 18 and 18' are welded to molybdenum foils 26 and 26' to form the inlead assemblies, with outer leads 28 and 28' welded to the opposite respective ends of molybdenum foils 26 and 26'. Plasma welding or laser welding is employed to melt that part of L-shaped portions 22 and 22' which touches the respective ends of filament 24 at the upper portion and which projects above the outer diameter of the filament. The length of the L-shaped leg of the spud must not be too long in order to avoid the molten metal of legs 22 and 22' which projects above the outer diameter of filament 24 from melting across more than one coil or turn of the filament when the spud is welded to the filament, which would short those coils out and reduce the effective length of filament 24. It is preferred to use laser or plasma welding because mechanical attachment introduces forces which cause distortion in the coil alignment, thereby offsetting the benefit of the spud centering. Plasma welding is particularly preferred. Accordingly, it has been found that the L-shaped portion 22 and 22' of spuds 10 and 10' can be welded to the outermost coil or turn of respective ends of filament 24 by having portions 22 and 22' touching the respective ends of filament 24 in such a position that the terminal portions of the coil ends are rotated to be offset by about 90° or one quarter turn with respect to leg portions 22 and 22'. In one embodiment of a miniature size lamp, spud 10 was fabricated from molybdenum wire 0.3 mm in diameter and filament 24 was a double coil having an outer diameter of about 1.4 mm.

Once the welds have been accomplished and filament assembly 30 has been formed, it is then drawn into a double ended lamp envelope which comprises vitreous envelope 40 having a generally spherical or elliptical filament chamber 42 whose outer diameter is greater than that of end tube portions 44 and 46 and which contains a coating or filter 48 on its outer surface which reflects infrared radiation emitted by the filament back to the filament and which transmits visible light radiation. The filament assembly 30 is drawn into envelope 40 by any suitable means with the filament 24 positioned in chamber 42 and radially aligned in the optical center thereof within limits of about 20% of its own diameter on axis, by spuds 10 and 10' which are positioned in bore 45 and 47 of tube portions 44 and 46, respectively. The outer diameter of spuds 10 and 10' is such that a slip fit is provided inside the bore 45 and 47 of tube portions 44 and 46. By way of an illustrative, but non-limiting example relating to a miniature size lamp, a 120 volt, 60 watt filament is placed in an elliptically shaped chamber formed in quartz tubing having outer and inner diameters of 5 and 3 mm, respectively. The maximum diameter of loop 12 will be equal to the minimum allowed diameter of the bore 45 and 47 of the tubing.

The coating 48 is preferably made up of alternating layers of a low refractory index material such as silica and a high refractory index material such as tantala, titania, niobia and the like for selectively reflecting and transmitting different portions of the electromagnetic spectrum emitted by the filament. In a preferred embodiment of the invention the filter will reflect infrared radiation back to the filament and transmit the visible portion of the spectrum. Such filters and their use as coatings for lamps may be found, for example, in U.S. Pat. Nos. 4,229,066 and 4,587,923 the disclosures of which are incorporated herein by reference.

Figure 4:
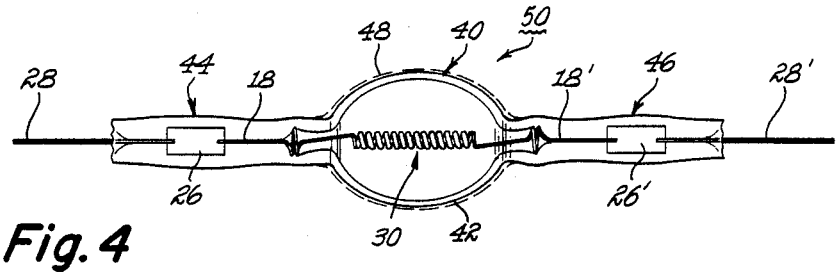
FIG. 4 schematically illustrates a double ended tungsten halogen lamp wherein the filament is supported and aligned within the filament chamber by spuds of the present invention.

FIG. 4 illustrates a completed lamp 50 comprising envelope portion 40 containing filament assembly 30 wherein both tubular end portions 44 and 46 have been shrink sealed over foil members 26 and 26' to form a hermetic seal and then cut to reduce their length to that desired. Outer leads 28 and 28' extend past the end of tube portions 44 and 46 which are cut to the desired length after assembly of the lamp. It will be obvious to those skilled in the art that all or a portion of spud legs 18 and 18' may be used to achieve the seal by pressing, pinching or shrinking the tube over same. Shrink seals are particularly preferred because deformation and misalignment of the tube portions of the lamp envelope are minimal as compared with that which can occur with pinch sealing. Shrink seals are known to those skilled in the art and examples of how to obtain same are found, for example, in U.S. Pat. Nos. 4,389,201 and 4,810,932, the disclosures of which are incorporated herein by reference.

The interior of filament chamber 42 contains an inert gas such as argon, xenon or krypton along with minor (i.e., $<10\%$) amounts of nitrogen, one or more halogen compounds such as methyl bromide, dibromomethane, dichlorobromomethane and the like and, optionally, phosphorous.

Figure 5:
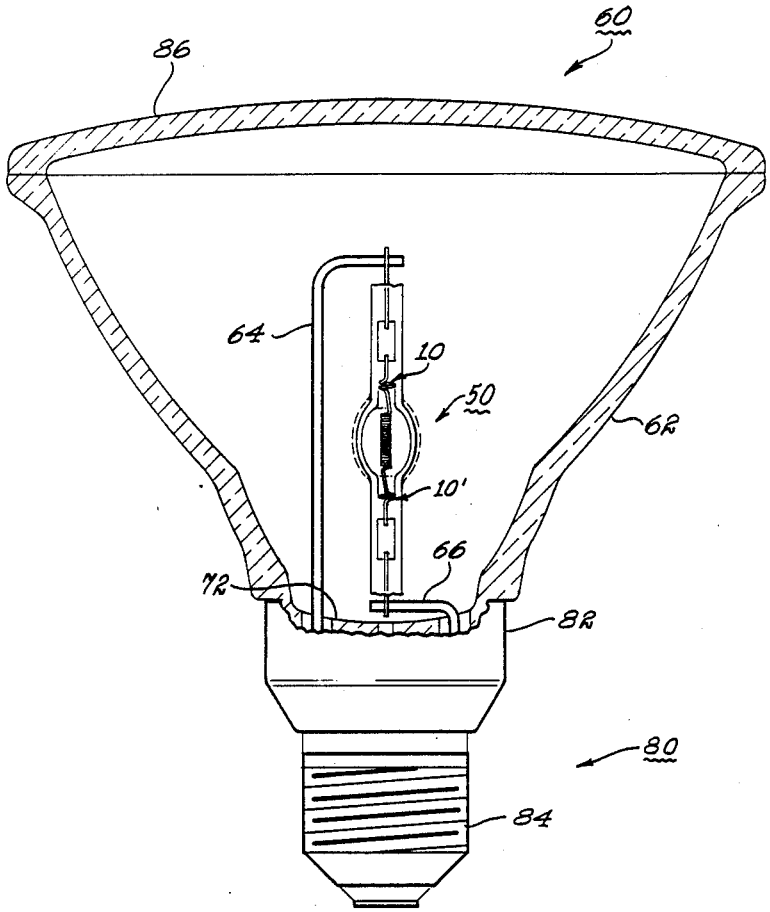
FIG. 5 schematically illustrates a combination double ended tungsten halogen lamp and parabolic reflector wherein the filament is supported and aligned in the lamp by spuds of the present invention.

Lamp 50 containing spuds 10 and 10' is shown assembled into a parobolic reflector 62 illustrated in FIG. 5. Thus, turning to FIG. 5, combination 60 contains lamp 50 mounted into the bottom portion of parabolic glass reflector 62 by means of conductive mounting legs 64 and 66 which project through seals (not shown) at the bottom portion 72 of glass reflector 62. Lamp base 80 is crimped onto the bottom portion of the glass reflector by means not shown at neck portion 82. Screw base 84 is a standard screw base for screwing the completed assembly 60 into a suitable socket. Glass or plastic lens or cover 86 is attached or hermetically sealed by adhesive or other suitable means to the other end of reflector 62 to complete the lamp assembly.

What is claimed is:

1. A spud for radially aligning and providing electricity to a filament in an electric lamp which comprises a refractory metal wire in the shape of a circular ring having at least one turn and with a loop on both sides of said ring having a diameter smaller than that of said ring and which extend toward the center thereof, with a leg extending out from the end of each of said loops away from each other and generally perpendicular to the plane of said ring.

2. The spud of claim 1 wherein one of said legs terminates in an L-shaped portion.

3. The spud of claim 2 wherein the other of said legs is coaxial with the center of said ring.

4. The spud of claim 3 wherein said leg which terminates in said L-shaped portion extends downward from the horizontal when viewed with said ring in a vertical position.

5. The spud of claim 4 wherein said L-shaped portion of said leg is offset at an angle off the vertical away from said spud ring when said ring is in a vertical position.

6. The spud of claim 5 wherein both of said loops terminate in a position coaxial with the center of said ring.

7. The spud of claim 6 wherein both of said legs are coaxial with the center of said ring at least at that portion of said spud wherein said legs extend from said loops.

8. A combination filament and spud wherein said spud is attached to said filament and comprises a refractory metal wire in the shape of a circular ring having at least one turn and with a loop on both sides of said ring having a diameter smaller than that of said ring and which extend toward the center thereof, with a leg extending out from the end of each of said loops away from each other and generally perpendicular to the plane of said ring, one leg being attached to said filament.

9. The combination of claim 8 wherein said filament is a coil filament.

10. The combination of claim 9 wherein one of said legs terminates in an L-shaped portion.

11. The combination of claim 10 wherein said L-shaped leg is attached to said filament.

12. The combination of claim 11 wherein said L-shaped leg is welded to said filament at the L-shaped portion thereof.

13. The combination of claim 12 wherein the other of said legs is coaxial with the center of said ring.

14. The combination of claim 13 wherein said leg which terminates in said L-shaped portion extends downward from the horizontal when viewed with said ring in a vertical position.

15. A double ended tungsten halogen lamp comprising a vitreous, light transmissive envelope having a mid portion of a predetermined generally spherical or elliptical shape as a filament chamber coated with an infrared reflecting and a visible light transmitting coating and enclosing a filament and one or more halogen compounds and inert gas within, said envelope terminating at each end in a tubular portion, with said filament being radially aligned in said chamber along the optical center thereof and being attached to and supported at each end by a spud located in each of said two tubular portions, said spud made of refractory metal wire in the shape of a ring having at least one turn and with a loop on each side of said ring having a diameter smaller than that of said ring and which extend towards the center thereof, with a leg extending out from the end of each of said loops away from each other and being generally perpendicular to the plane of the ring and coaxial with respect to the center thereof with one of each of said legs welded to a respective end of said filament and the other of each of said legs being at least a portion of an inlead.

* * * * *